US005369417A

United States Patent [19]

Tanaka

[11] Patent Number: 5,369,417

[45] Date of Patent: Nov. 29, 1994

[54] SAMPLE AND HOLD CIRCUIT BEING ARRANGED FOR EASILY CHANGING PHASES OF SHIFT CLOCKS

[75] Inventor: Junji Tanaka, Sakurai, Japan

[73] Assignee: Sharp Kabushiki Kaisha, Osaka, Japan

[21] Appl. No.: 36,273

[22] Filed: Mar. 24, 1993

[30] Foreign Application Priority Data

Mar. 31, 1992 [JP] Japan ..... 4-76941

[51] Int. Cl.[5] ..... G09G 3/36

[52] U.S. Cl. ..... 345/98; 345/100

[58] Field of Search ..... 340/784; 375/67; 307/582, 510, 479; 377/49, 69, 85; 345/98, 100, 99

[56] References Cited

U.S. PATENT DOCUMENTS

| | | | |
|---|---|---|---|
| 3,768,022 | 10/1973 | Lang | 375/67 |
| 4,213,094 | 7/1980 | Wood | 375/67 |
| 4,499,459 | 2/1985 | Sasaki | 340/784 |
| 4,758,890 | 7/1988 | Boyce | 358/17 |

*Primary Examiner*—Ulysses Weldon
*Assistant Examiner*—Aaron Banerjee

[57] ABSTRACT

A sample and hold circuit is arranged to have a first shift register, a second shift register, a first group of sample and hold elements, a second group of sample and hold elements, and a phase switching circuit. The first shift register has a serial-in and parallel-out function and serves to shift an input sampling pulse in synchronization to the first shift clock. The second shift register has a serial-in and parallel-out function and serves to shift the input sampling pulse in a synchronous to a second shift clock being different from the first shift clock by a predetermined angle of phase. The first group of sample and hold elements serves to sample an analog signal in synchronization to an output from the first shift register. The second group of sample and hold elements serves to sample an analog signal in synchronization an output from the second shift register. The phase switching circuit serves to switch a phase relation between the first shift clock and the second shift clock in a manner so as to keep a predetermined phase angle between the first and the second shift clocks.

6 Claims, 6 Drawing Sheets

SAMPLE AND HOLD CIRCUIT BEING ARRANGED FOR EASILY CHANGING PHASES OF SHIFT CLOCKS

BACKGROUND OF THE INVENTION

1. Field of the Invention

The present invention relates to a sample and hold circuit, and more particularly to the sample and hold circuit which is suitably arranged for a source driver for a liquid crystal panel.

2. Description of the Related Art

The inventors of the present application know a sample and hold circuit for a source driver of a liquid crystal panel which has been heretofore proposed. An example of the known circuit together with its connected liquid crystal panel will be shown in FIG. 1. As shown, numerals 51 and 52 denote sample and hold circuits which are used for feeding an image signal to a liquid crystal panel 53. The sample and hold circuit 51 provides two bidirectional shift registers 511 and 512, a sample and hold unit 513, and an output unit 514. Likewise, the sample and hold circuit 52 provides two bidirectional shift registers 512 and 522, a sample and hold unit 523, and an output unit 524.

The bidirectional shift registers 511, 512, 521, 522 receive serial signals but supply parallel signals. These shift registers respectively take sampling pulses SP1, SP2, SP1′ and SP2′, shift these sampling pulses in the direction specified in synchronous to the shift clocks $\phi 1$, $\phi 2$, $\phi 1'$, $\phi 2'$, and supply these results at respective stages. The apostrophe character "′" designates the inverse or complement of a particular signal having high level (high) and low level (low) states.

Each of the sample and hold units 513 and 523 is composed of a plurality of sample and hold elements. The plurality of sample and hold elements for each sample and hold unit are divided into a first group and a second group. The first group of sample and hold elements receive an analog signal VA as a signal to be sampled and held and the second group of sample and hold elements receive an analog signal VB as a signal to be sampled and held. At each element belonging to the first group of the sample and hold unit 513, an output pulse is applied from each stage of the shift register 511. At each element belonging to the second group of the sample and hold unit 513, an output pulse is applied from each stage of the shift register 512. At each element belonging to the first group of the sample and hold unit 523, an output pulse is applied from each stage of the shift register 521. At each element belonging to the second group of the sample and hold unit 523, an output pulse is applied from each stage of the shift register 521. When such a pulse is applied from the shift register to each sample and hold element, the sample and hold element holds analog signals VA and VB. As shown, the elements of the first group and the elements of the second group are arranged in an alternate manner. In the arrangement, a pair of adjacent sample and hold elements belonging to the first and the second groups receive outputs from the same stages of the two shift registers.

Each of the output units 514 and 524 is composed of a plurality of output circuits, each of which is arranged to have an operational amplifier. The signals VA and VB held in each sample and hold element are supplied to the liquid crystal panel 53 through each output circuit of the output units 514 and 524. Each output circuit of the output unit 514 receives the output signals VA and VB of two sample and hold elements to which output pulses are applied from the same stages of the shift register 511 and 512. Likewise, each output circuit of the output unit 524 receives the output signals VA and VB of a pair of two sample and hold elements into which output pulses are applied from the same stages of the shift registers 521 and 522. Each output circuit serves to select any one of these two signals in response to the control signal CNT and output it.

The liquid crystal panel 53 is composed of a plurality of pixel lines, each of which is arranged to have a plurality of pixels 531 ranged in a horizontal manner. At the pixel lines in odd numbered order counted from the above, an analog signal VA is applied. At the pixel lines in even numbered order counted from the above, an analog signal VB is applied. The analog signals VA and VB are switched to each other in response to the control signal CNT. Which of the lines are to be driven by the analog signals VA and VB are determined by a gate driver 54. The odd-number pixels counted from the left margin of each line are driven by the analog signals VA and VB from the sample and hold circuit 51. The even-number pixels counted from the left margin of each line are driven by the analog signals VA and VB from the sample and hold circuit 52. As shown in FIG. 1, the even-number lines are shifted to the left hand by a half pixel with respect to the odd-number lines located thereabove.

FIG. 2 is a chart showing how the shift clocks $\phi 1$, $\phi 2$, $\phi 1'$, and $\phi 2'$ fed to the sample and hold circuits 51 and 52 are operated. Now, it is assumed that these shift registers are both operated at a right-shift mode and the shift register 511 reads a sampling pulse SP1 at the rising timing T2 of the clock $\phi 1$. On the timing, the sampling pulse is output at the left-end output terminal of the shift register 511. In response to the sampling pulse, the leftmost sample and hold element in the first group of the sample and hold unit 513 receives the analog signal VA and holds it. The signal is fed to the leftmost pixel of the first line through the output unit 514. At a timing T4 located a half clock later than the timing T2, the clock $\phi 1'$ rises. In response, the sampling pulse SP1′ is received by the shift register 521. On the timing, the sampling pulse is output at the leftmost output terminal of the first group of the shift register 521. As a result, the leftmost sample and hold element of the sample and hold unit 523 receives and holds the analog signal VA. The signal is fed to the second leftmost pixel of the first line through the output unit 524.

Likewise, on the timing T1, the clock $\phi 2$ has risen. At a time, the sampling pulse SP2 is taken into the shift register 512. On the timing, the sampling pulse is output from the leftmost output terminal of the shift register 512. In response, the second leftmost sample and hold element of the second group of the sample and hold unit 513 serves to receive and hold the analog signal VB. The analog signal VB is supplied to the leftmost pixel of the second line through the output unit 514. On the timing T3, the clock $\phi 2'$ has risen. At a time, the sampling pulse SP2′ is received by the shift register 522. On this timing, the leftmost output terminal of the shift register 522 serves to output a sampling pulse. In response, the second leftmost sample and hold element of the second group of the sample and hold unit 523 serves to receive the analog signal VB and hold it. The signal is supplied to the second leftmost pixel of the second line through the output unit 524. Likewise, each time each shift clock rises, the sampling pulse is shifted within the shift register in a manner to sequentially sample and hold the analog signals VA and VB, which are supplied to each pixel.

The display device arranged to use the liquid crystal panel often needs to reverse the left and the right parts of the display. The reverse display can be realized by executing a sample and hold operation of the analog signals VA and VB in sequence from the rightmost sample and hold element of the sample and hold unit, not from the leftmost sample and hold element. For that purpose, it is just necessary to reverse the shifting direction of the sampling pulse in the shift register into an opposite direction and the phase relation of the shift clocks $\phi 1$, $\phi 1'$ and $\phi 2$, $\phi 2'$ as shown in FIG. 3. In other words, the phases of the shift clocks $\phi 1$ and $\phi 2$ are just required to be lagged by a half period from the phases of the shift clocks $\phi 1'$ and $\phi 2'$.

However, the sample and hold circuit known by the inventors of the present applicant has required an external circuit for changing the phases of such shift clocks. The provision of the external circuit results in making the overall device complicated.

SUMMARY OF THE INVENTION

It is an object of the present invention to provide a sample and hold circuit which is arranged to easily change the phases of shift clocks without having to provide an additional external circuit.

In carrying out the object, a sample and hold circuit having a capability of easily changing a phase relation of shift clocks, includes: a first shift register having a serial-in and parallel-out function and for shifting an input sampling pulse in synchronous to a first shift clock and outputting the shifted sampling pulse; a second shift register having a serial-in and parallel-out function and for shifting an input sampling pulse in synchronous to the second shift clock being different from the first shift clock by a predetermined angle of phase; a first group of sample and hold elements provided to have a plurality of sample and hold elements and for sampling an analog signal in synchronous to an output from the first shift register; a second group of sample and hold elements provided to have a plurality of sample and hold elements and for sampling an analog signal in synchronization to an output from the second shift register; and a phase switching circuit for switching a phase relation between the first shift clock and the second shift clock in a manner to produce a difference between the first shift clock and the second shift clock have a predetermined phase angle.

In operation, each shift register operates to shift a sampling pulse in synchronization to an input shift clock and feed the sampling pulse from a plurality of output terminals in a parallel manner. The plurality of sample and hold elements belonging to each group operate to take a sampling of an analog signal in synchronization to the outputs from the plurality of output terminals provided in each shift register. The shift clock input to each shift register enables the phase switching circuit to switch the phase. This results in making it possible to easily switch the sequence in which the shift registers output a pulse. The first and the second sample and hold element groups enable to change the sequence in which each sample and hold element takes a sampling of an analog signal. This operation means that the sampling circuit of this invention needs only a simple circuit arrangement for easily reversing the right and the left parts of the screen.

Further objects and advantages of the present invention will be apparent from the following description of the preferred embodiment of the invention as illustrated in the accompanying drawings.

DESCRIPTION OF THE PREFERRED EMBODIMENT

Figure 1:
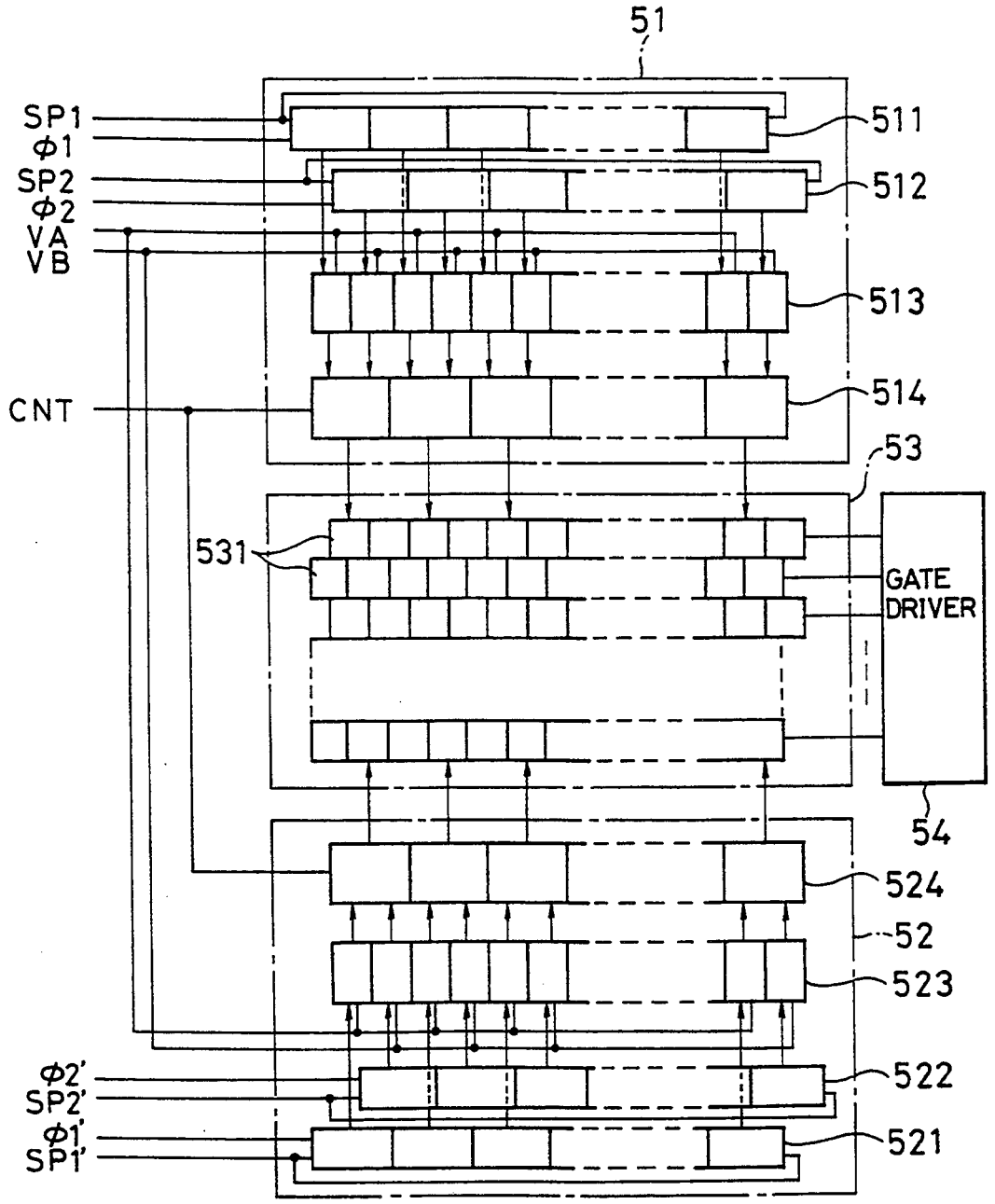
FIG. 1 is a block diagram showing a sample and hold circuit known by the inventors of the present application.

Now, the description will be directed to a sample and hold circuit according to an embodiment of the invention as referring to the drawings.

Figure 4:
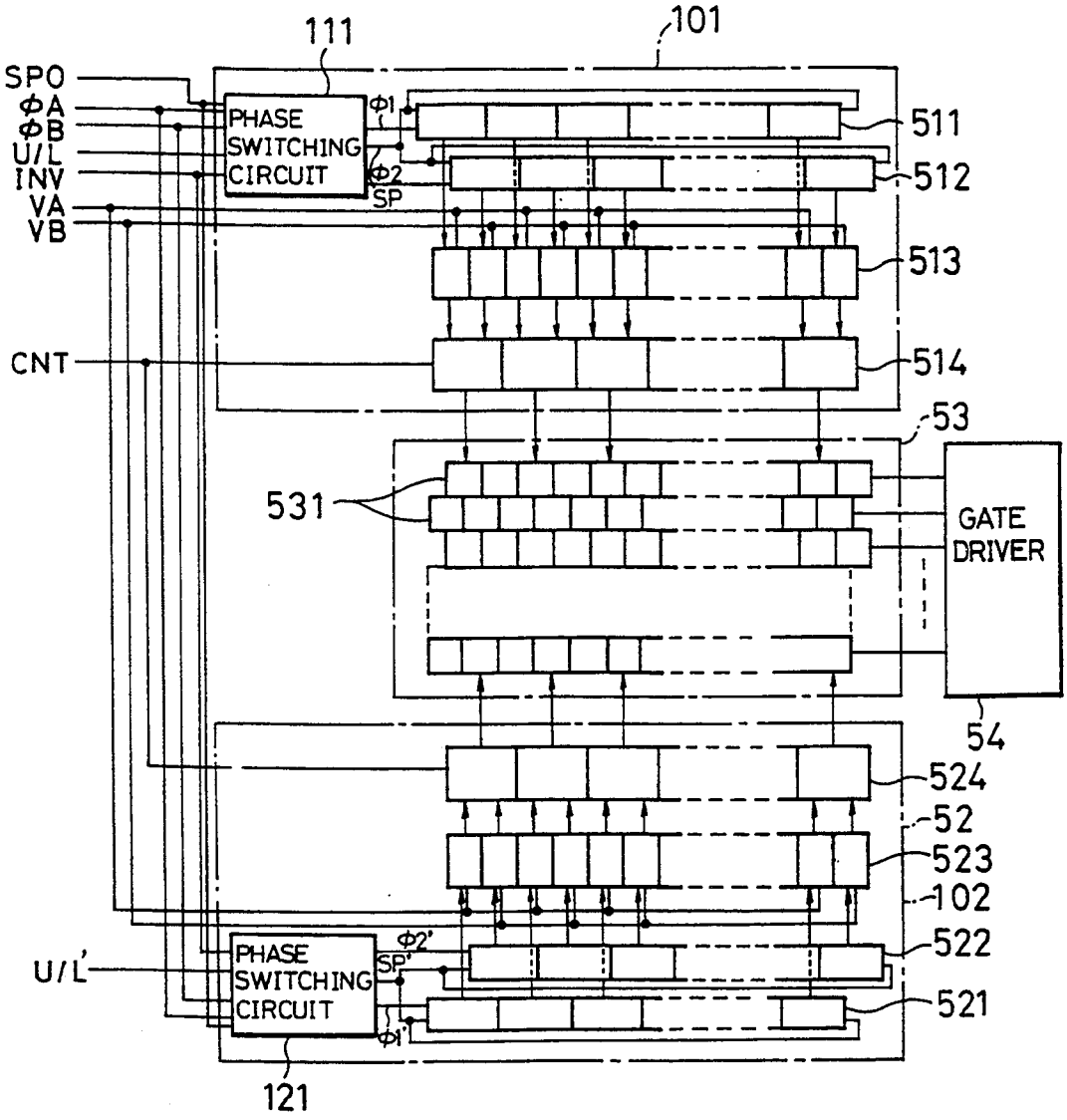
FIG. 4 is a block diagram showing a sample and hold circuit according to an embodiment of the invention.

FIG. 4 shows a sample and hold circuit according to this embodiment. As shown, numerals 101 and 102 denote sample and hold circuits. The difference between these circuits from the sample and hold circuit shown in FIG. 1 is that phase switching circuits 111 and 121 are provided for those circuits 101 and 102, respectively. That is, shift clocks and sampling clocks are supplied to each shift register through the phase switching circuits 111 and 121. The circuits 111 and 121 receive shift clocks $\phi A$ and $\phi B$, a reverse control signal INV and a sampling pulse SPO. The circuit 111 receives an upper and lower switching signal U/L and the circuit 121 receives a phase switching signal U/L'. The switching circuit 111 serves to output the shift clocks $\phi 1$ and $\phi 2$ to the shift registers 511 and 512, respectively and the sampling pulse SP to the shift registers 511 and 512. Further, the switching circuit 121 serves to output the shift clocks $\phi 1'$ and $\phi 2'$ to the shift registers 521 and 522, respectively and the sampling pulse SP' to the shift registers 521 and 522.

Figure 5:
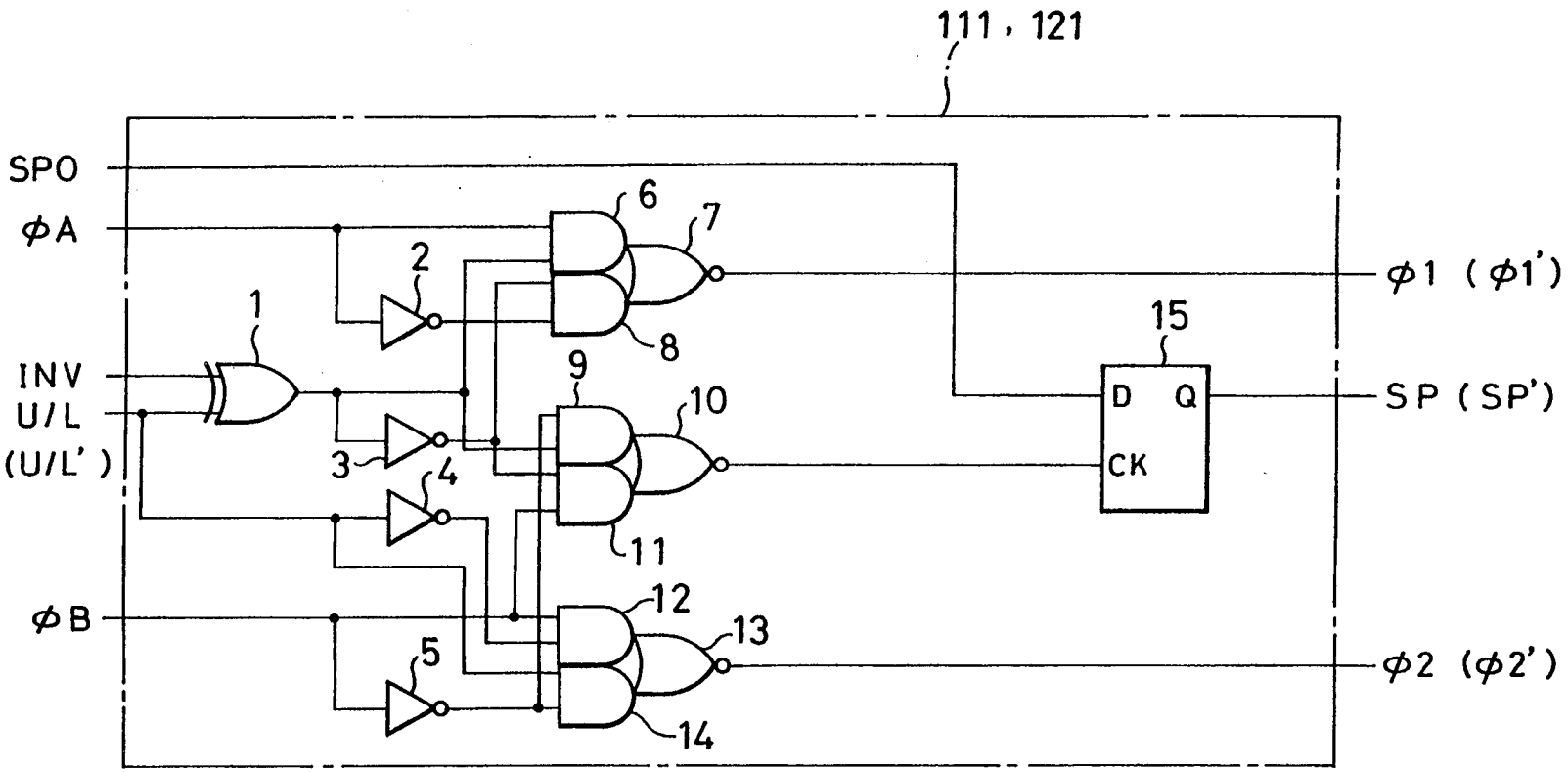
FIG. 5 is a circuit diagram showing a phase switching circuit composing the sample and hold circuit shown in FIG. 4.

FIG. 5 is a circuit diagram showing each of the phase switching circuits 111 and 121. Both of the circuits have the same arrangement. Hence, the following description will be directed to only the switching circuit 111. Numerals 6 to 8 denote gate circuits which comprise a first selector. The first selector serves to select any one of a shift clock $\phi A$ or a reversed, i.e. inverted, shift clock $\phi A$ produced by a reversing or inverter circuit 2 and then reverse the selected shift clock signal one and output it as a shift clock or $\phi 1'$. Numerals 9 to 11 denote gate circuits which comprise a second selector. The second selector serves to select any one of a shift clock $\phi B$ or a reversed shift clock $\phi B'$ produced by the reversing circuit 5 and reverse the selected shift clock signal and output it. Numerals 12 to 14 denote gate circuits which comprise a third selector. The third selector serves to select any one of a shift clock $\phi B$ or a reversed shift clock $\phi B'$ produced by the reversing circuit 5 and reverse the selected shift clock signal and output it as a shift clock $\phi 2'$.

In FIG. 5 numeral 1 denotes an exclusive OR circuit to which both of the reverse control signal INV and the upper and lower switching signal U/L or is complement U/L' are applied. The exclusive OR circuit 1 sends its output directly to the first and the second selectors as a selected signal. The output of the exclusive OR circuit 1 is also reversed by a reversing circuit S. The reversed signal from circuit 3 is applied as another selecting input signal into the first and the second selectors. When the output signal of the exclusive OR circuit 1 is at a high level (high), the first selector selects the shift clock $\phi A$ and the second selector selects the reversed shift clock $\phi B$.

The upper and lower switching signal U/L is reversed by a reversing circuit 4. The signal U/L and its reversed signal U/L' are applied into the third selector as its selecting signal. When the upper and lower switching signal U/L is at a high level (high), the third selector selects the reversed shift clock $\phi B'$.

Reference numeral 15 denotes a D type flip-flop which serves to synchronize the sampling pulse SP0 with an output signal of the second selector and output a sampling pulse SP.

In turn, the description will be directed to how the sample and hold circuit operates. A high-level (high) upper and lower switching signal U/L is applied into the switching circuit 111 provided in the upper sample and hold circuit 101, while a low-level low upper and lower switching signal U/L' is applied into the switching circuit 121 provided in the lower sample and hold circuit 102. If a symmetrical reversing is not needed on the liquid crystal panel 53, a high-level reverse control signal INV is applied to the switching circuit. Herein, the shift clocks $\phi A$ and $\phi B$ are the reversed ones $\phi 1'$ and $\phi 2'$ of the shift clocks $\phi 1$ and $\phi 2$ shown in FIG. 2.

Figure 2:
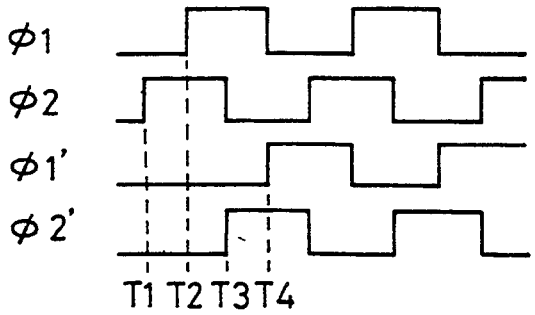
FIG. 2 is a timing chart for explaining how the known sample and hold circuit operates.

In that case, in the switching circuit 111, the exclusive OR circuit 1 serves to output a low-level (low) signal. As such, the first selector selects the shift clock $\phi A$, reverses it to $\phi A$ and output the reversed clock as a shift clock $\phi 1$. At the same time, the third selector selects the reversed shift clock $\phi B$, reverses it to $\phi B$ and outputs the reversed clock as a shift clock $\phi 2$. The phase relation between the shift clocks $\phi 1$ and $\phi 2$ is as shown in FIG. 2. The second selector selects the shift clock $\phi B$. Hence, the flip-flop 15 outputs the sampling pulse SP in synchronism with the reversed shift clock $\phi B'$.

On the other hand, in the switching circuit 121, the exclusive OR circuit 1 outputs a high-level (high) signal. As such, the first selector selects the shift clock $\phi A$, reverses it to $\phi A'$ and outputs the reversed signal as a shift clock $\phi 1'$. At a time, the third selector selects the shift clock $\phi B$, reverses it $\phi B'$ and output the reversed signal as a shift clock $\phi 2'$. The phase relation between the shift clocks $\phi 1'$ and $\phi 2'$ is as shown in FIG. 2. Further, since the second selector selects the reversed shift clock $\phi B'$, the flip-flop 15 outputs the sampling pulse SP in synchronous to the shift clock $\phi B$.

As such, when the high-level (high) reverse control signal INV is applied into the switching circuit, the shift clocks $\phi 1$, $\phi 2$, $\phi 1'$ and $\phi 2'$ maintaining the phase relation as usual are supplied to the shift registers 511, 512, 521, and 522. This results in keeping the display on the liquid crystal panel non-reversed.

Figure 3:
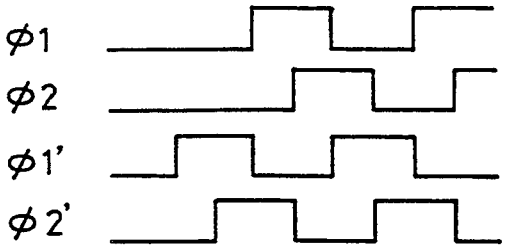
FIG. 3 is a timing chart showing a phase relation of shift clocks required for executing symmetric reversing on a liquid crystal display.
Figure 6:
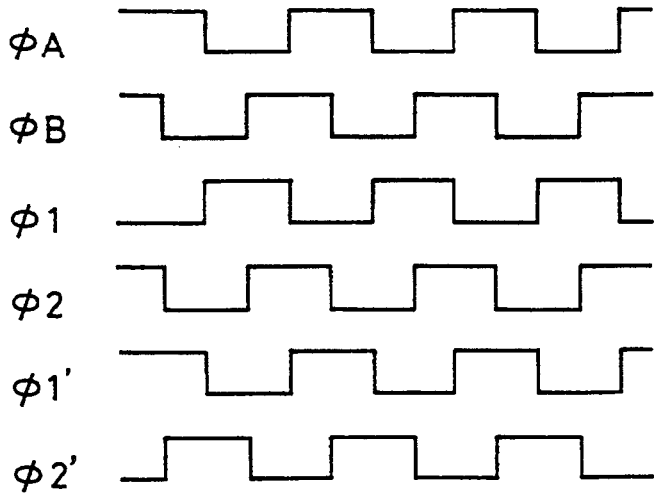
FIG. 6 is a timing chart for explaining how the sample and hold circuit shown in FIG. 4 operates.

Next, assume that a low-level (low) reverse control signal INV' is applied into the switching circuit. In the switching circuit 111, the exclusive OR circuit 1 serves to output a high-level signal. Hence, the first selector selects a shift clock $\phi A$, reverse it to $\phi A'$ and output the reversed signal as a shift clock $\phi 1$. At the same time, the third selector selects the reversed shift clock $\phi B'$, reverses it to $\phi B'$ and outputs the reversed signal as a shift clock $\phi 2$. The phase relation of the shift clocks $\phi 1$ and $\phi 2$ is made to be as shown in FIG. 6. It matches the phase relation required for the reverse display as shown in FIG. 3. The second selector selects the reversed shift clock $\phi B'$. Hence, the flip-flop 15 outputs the sampling pulse SP in synchronization to the shift clock $\phi B$.

On the other hand, in the switching circuit 121, the exclusive OR circuit 1 is enabled to output a low-level (low) signal. Hence, the first selector selects the reversed shift clock $\phi A'$, reverses it to $\phi A'$ and outputs the reversed signal as the shift clock $\phi 1'$. At the same time, the third selector selects the shift clock $\phi B$, reverses to $\phi B'$ it and outputs the reversed signal as the shift clock $\phi 2'$. At this time, the phase relation of the shift clocks $\phi 1'$ and $\phi 2'$ is made to be as shown in FIG. 6. It matches to the phase relation required for the reverse display shown in FIG. 3. The second selector selects the shift clock $\phi B$. Hence, the flip-flop 15 outputs the sampling pulse SP in synchronous to the shift clock $\phi B$.

Figure 7:
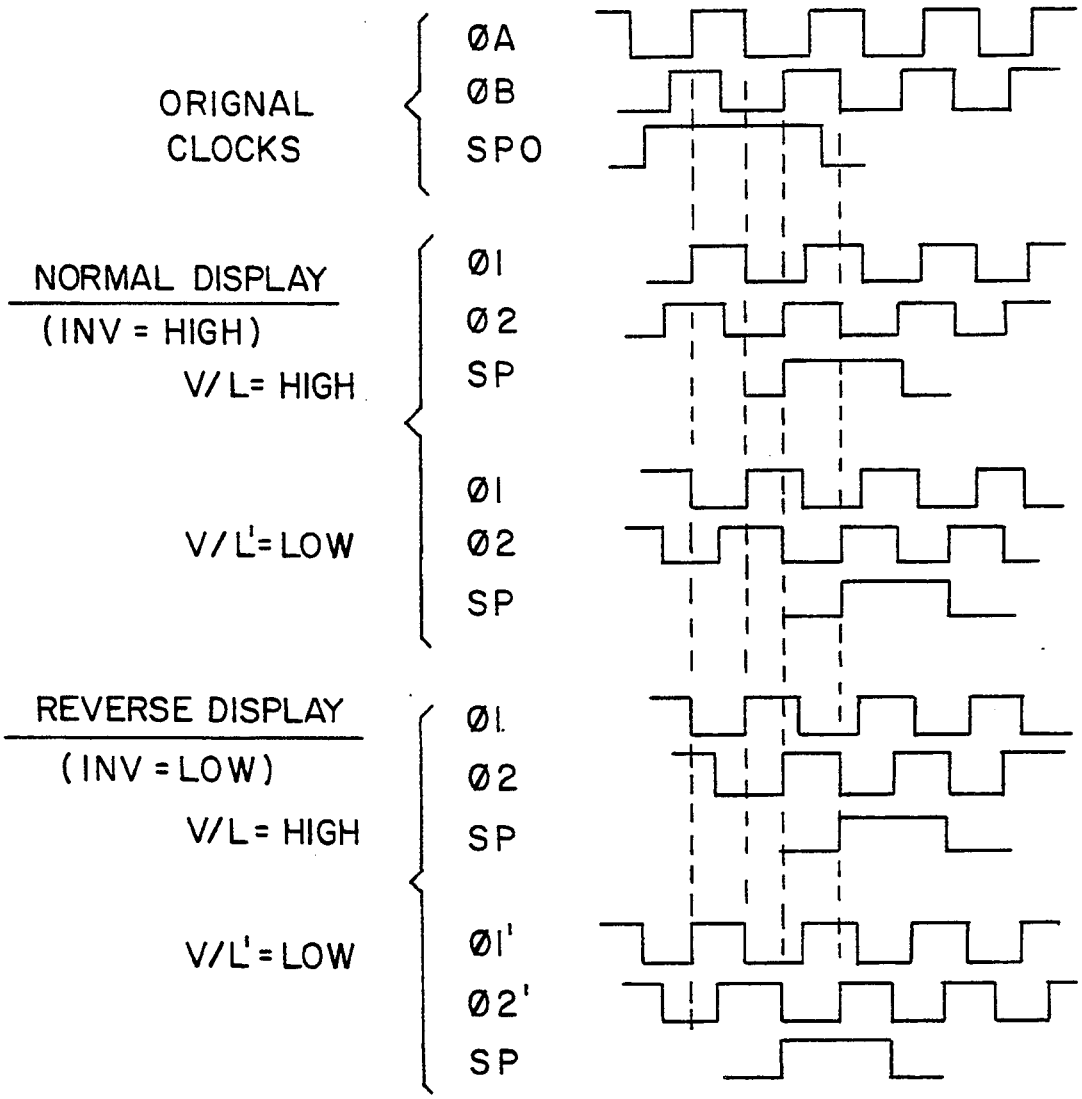
FIG. 7 is a timing chart illustrative of the phase relation of shift clocks of FIG. 4 for normal and reverse displays.

As is easily understood from the above description, just by reversing the logic level of the reverse control signal INV', the sample and hold circuits 101 and 102 according to the embodiment shown in FIG. 4 operate to switch the phase of each shift clock $\phi A$ and $\phi B$ and accordingly $\phi 1$, $\phi 2$, $\phi 1'$, $\phi 2'$ as shown in FIG. 7 so as to make the symmetric reversing on the liquid crystal display 53 possible.

Many widely different embodiments of the present invention may be constructed without departing from the spirit and scope of the present invention. It should be understood that the present invention is not limited to the specific embodiments described in the specification, except as defined in the appended claims.

What is claimed is:

1. A driving circuit for a liquid crystal display panel including a plurality of pixel lines, each line arranged to have a plurality of pixels arranged in a horizontal manner, and pixels of odd lines and pixels of even lines being staggered relative to each other, comprising:

a first sample and hold circuit for supplying analog signals to odd numbered pixels of each line of the liquid crystal display panel; and a second sample and hold circuit for supplying analog signals to even numbered pixels of each line of the liquid display panel;

each of said first and second sample and hold circuits further comprising, a first shift register including a plurality of serially connected stages and having a serial-in and parallel-out function and for shifting an input sampling pulse in synchronization to a first shift clock and outputting the shifted sampling pulse, a second shift register including a plurality of serially connected stages and having a serial-in and parallel-out function and for shifting the input sampling pulse in synchronization to a second shift clock, said second shift clock being different from said first shift clock by a predetermined angle of phase, a first group of sample and hold elements for sampling a first analog signal for odd numbered lines of the liquid crystal display in synchronization to outputs from respective stages of said first shift register, a second group of sample and hold elements for sampling a second analog signal for even numbered lines of the liquid crystal display in synchronization to outputs from respective stages of said second shift register, and a phase switching circuit for supplying said first shift register with said sampling pulse and said first shift clock and for supplying said second shift register with said sampling pulse and said second shift clock, said phase switching circuit further comprising, means for switching a phase relation between said first shift clock and said second shift clock so as to have a difference therebetween of a predetermined phase angle, thereby permitting said first and second sample and hold element groups to reverse the sequence in which each sample and hold element receives a sampling of analog signals, said switching means being arranged to receive first and second original shift clocks, an original sampling pulse, a first control signal instructing an inversion of the display, and a second control signal designating the sample and hold circuit as either of said first and second sample and hold circuits, and to have a first selector for selecting either the received first original shift clock or the reversal thereof as said first shift clock based on the received first and second control signals, a second selector for selecting either the received second original shift clock or the reversal thereof based on the received first and second control signals, a third selector for selecting either the received second original clock or the reversal thereof as said second shift clock based on the received second control signal, and a flip-flop circuit connected to receive the input original sampling pulse and a clock selected by said second selector for outputting said sampling pulse in synchronization to said clock selected by said second selector.

2. A driving circuit as claimed in claim 1, wherein said first original shift clock is advanced or lagged in phase relative to said second original shift clock by a quarter period.

3. A driving circuit as claimed in claim 1, wherein said switching means switches the phases of the first and second shift clocks relative to each other by advancing or retarding one of said shift clocks relative to the other by a quarter period.

4. A driving circuit as claimed in claim 1, wherein said first and second shift register comprise bidirectional shift registers.

5. A driving circuit as claimed in claim 1, wherein said sample and hold elements of the first and second groups are alternately staggered and a pair of adjacent sample and hold elements are connected to receive outputs from the same stages of the two shift registers.

6. A driving circuit as claimed in claim 3, further including an output unit having a plurality of output circuits for supplying the analog signals held by respective sample and hold elements, each output circuit being connected to receive output signals of said adjacent sample and hold circuits and outputting one of the received analog signals in response to an input control signal.

* * * * *